United States Patent [19]

Deconinck

[11] 4,327,456

[45] May 4, 1982

[54] APPARATUS FOR APPLYING A PROCESSING LIQUID TO A SHEET OR WEB MATERIAL

[75] Inventor: Hugh F. Deconinck, Deurne-Zuid, Belgium

[73] Assignee: AGFA-GEVAERT N.V., Mortsel, Belgium

[21] Appl. No.: 186,387

[22] Filed: Sep. 11, 1980

[30] Foreign Application Priority Data

Sep. 13, 1979 [GB] United Kingdom ..... 31773/79

[51] Int. Cl.[3] ..... G03D 5/06; G03D 3/13

[52] U.S. Cl. ..... 15/102; 15/256.51; 118/104; 134/122 P; 354/318; 354/321

[58] Field of Search ..... 354/317, 318, 320, 321, 354/322, 324; 118/104, 203; 101/365, 366; 15/102, 256.51; 134/122 P

[56] References Cited

U.S. PATENT DOCUMENTS

| | | | |
|---|---|---|---|
| 3,468,693 | 9/1969 | Hanson | 354/320 |
| 3,589,261 | 6/1971 | Krikelis | 354/322 |
| 3,712,204 | 1/1973 | Aelterman | 354/324 |
| 4,034,389 | 7/1977 | Huss | 354/320 |
| 4,141,314 | 2/1979 | Newson | 354/318 |
| 4,142,790 | 3/1979 | Neeb et al. | 354/318 |

FOREIGN PATENT DOCUMENTS

| | | | |
|---|---|---|---|
| 2015626 | 10/1971 | Fed. Rep. of Germany | 118/104 |

*Primary Examiner*—L. T. Hix
*Assistant Examiner*—Alan Mathews
*Attorney, Agent, or Firm*—William J. Daniel

[57] ABSTRACT

The deposit of solid residue upon the exit squeeze rollers following immersion of sheet- or weblike materials in a bath of treatment liquid and the transfer of the residue to the materials themselves is avoided by an applicator which applies a film of moistening liquid to the periphery of one such exit roller so that the exit rollers are sufficiently wetted as to dissolve the solid residue before a sheet or web passes therethrough.

3 Claims, 3 Drawing Figures

APPARATUS FOR APPLYING A PROCESSING LIQUID TO A SHEET OR WEB MATERIAL

Figure 1:
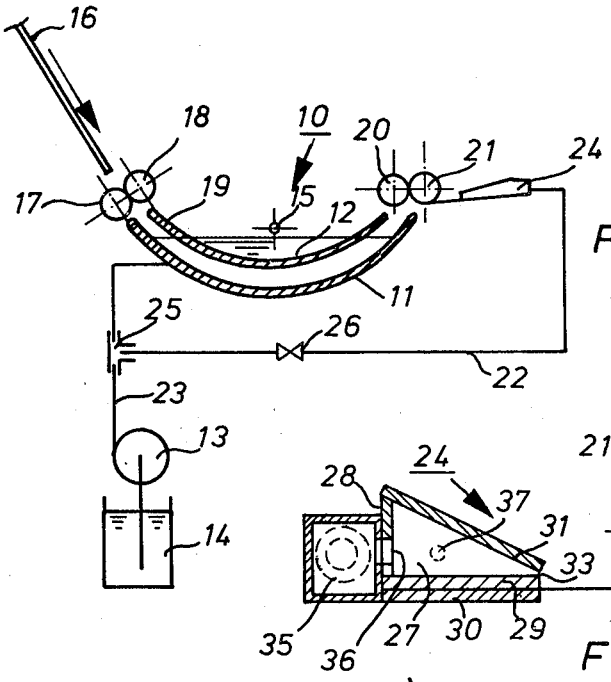

This invention is concerned with processing apparatus. More particularly it is concerned with processing apparatus for the treatment of sheet- or web-like materials.

The invention has especial importance in the field of processing photographic materials wherein the surface of such materials is treated with at least one processing liquid or with a plurality of processing liquids in succession in one or more processing stations.

The processing stations used in such a processing apparatus generally comprise a shallow tray for containing a predetermined amount of processing liquid, a pair of inlet rollers and a pair of exit rollers in order to guide the material into and out of the tray.

A processing station of this kind suffers from the drawback that the exit roller pair, when the apparatus is only intermittently used, runs dry due to evaporation with the consequence that components of processing liquid solidify and accumulate on the peripheral surface of the rollers. Such solid deposit is transferred to the next coming sheet thereby impairing the quality of the latter.

It has been proposed to partly immerse at least one of the exit rollers in the processing liquid. Although in this way the deposition of solid substance is avoided due to the continuous wetting, another inconvenience is met which is characterized by a decrease in reproducibility of the process.

Indeed, the film of processing liquid which is present on the surface of each roller so immersed becomes partly oxidized so that the effect of said liquid in the treatment of the sheet is uncontrollable. Also the squeezing effect of the exit roller pair is partly reduced.

Another solution to the problem of the deposition of solid substance is offered by the wetting of the surface of the roller(s) of the exit roller pair with the help of a wick or other porous strip. Unfortunately, the material of such members looses part of its initial property in becoming harder with time which may lead to a surfacial damage of the exit roller(s).

It is therefore an object of the invention to provide a processing apparatus which does not show the aforementioned drawbacks.

According to the invention, there is provided: An apparatus for use in the controlled application of a processing liquid to material in sheet or web form, such apparatus comprising at least one container for holding a quantity of processing liquid, means for feeding a said material along a path leading into said container, means comprising a pair of exit rollers located for receiving such material from an exit region of the container and for squeezing surplus liquid from such material during its advance from the container, and wetting means associated with one of said exit rollers for supplying that roller with liquid deriving otherwise than from sheet material passing between the two exit rollers, characterised in that said wetting means comprises an applicator member having a surface along which a layer of liquid can flow to said associated roller and which bears yieldingly against the surface of that roller along a contact zone parallel with the roller axis and spaced from the nip between the two exit rollers, so that a bead of liquid can be maintained at that zone between said surface and that associated roller.

In a preferred embodiment, the surface of the applicator member is disposed at an inclination to the horizontal so that the film of liquid is allowed to flow under gravity along said surface towards the associated roller in order to contact the bottom of the latter.

The liquid for wetting the said roller may be supplied intermittently or continuously. The latter method, however, is strictly spoken unnecessary because the time lapse occurring between the introduction of a sheet or web between the inlet rollers and the passing of said sheet or web between the two exit rollers is sufficiently high for the preliminary cleaning of the said rollers. If desired, however, the cleaning liquid may be supplied continuously.

The means supplying liquid to said applicator member comprises a liquid distributor head having a liquid delivery orifice or orifices extending or distributed along a path adjacent said applicator member and parallel with said contact zone. The liquid supply member itself is connected either to the conduit delivering processing liquid to the processing tray, so that the cleaning of the exit rollers is carried out with processing liquid, or to a conduit through which water can be delivered. In the second case the necessary precautions have to be taken in order to avoid the mixing of the water with the processing liquid in the underlying processing tray. The water that is not used in the cleaning process must be drained off separately. Therefore the applicator member must extend beyond the extremities of the exit rollers, so that the water may flow away at the side edges of the tray where it can be collected.

The applicator member itself may be in the form of a leafspring, of somewhat greater length than the axial dimensions of the exit rollers although other materials may be used, provided they are sufficiently resistant to the chemical action of the cleaning liquid.

An apparatus as described hereinbefore does not show the inconveniences of prior art devices in that the urging of the applicator member against the roller periphery provides for the creation of a liquid bead which is sufficiently great to quickly dissolve solid residue present on the roller periphery whereas a doctoring effect avoids an exaggerated moistening of the roller periphery. It therefore suffices to operate the liquid supply mechanism only during periods that the processing apparatus is in use.

Figure 2:
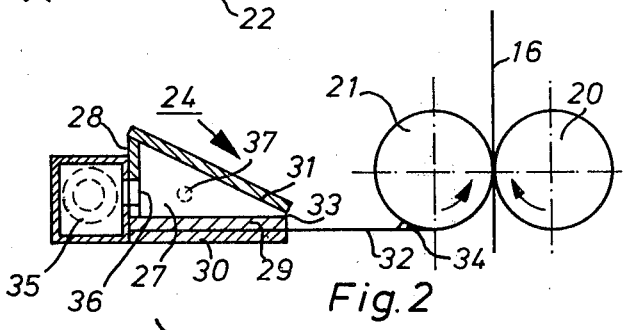
Figure 3:
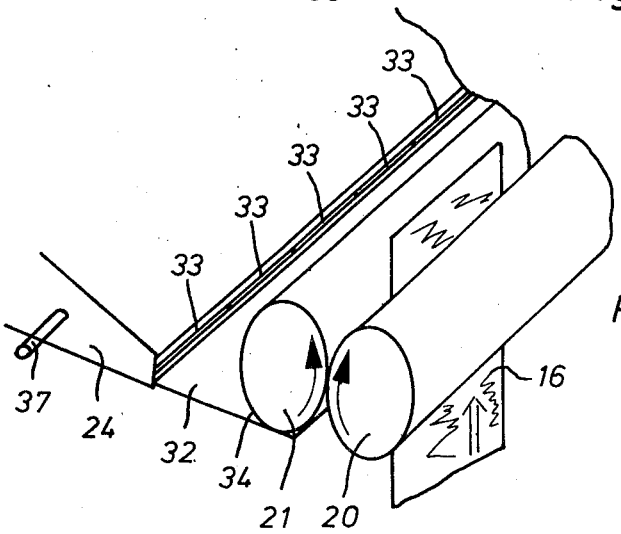

A preferred embodiment according to the invention is represented in the accompanying drawings, in which:

FIG. 1 is a sectional view of a processing apparatus according to the invention, FIG. 2 is a detail of FIG. 1, FIG. 3 shows a perspective view of the exit roller wetting system in the processing apparatus according to the invention.

As may be seen in FIGS. 1 and 2, a processing apparatus 10 according to the invention comprises a tray 11 which is filled to a predetermined level with processing liquid 12. The processing liquid 12 is supplied by a pump 13 from a storage tank 14. An overflow opening 15 keeps the predetermined level constant. An exposed photographic material 16 is introduced through the nip of a pair of inlet rollers 17, 18 into the tray 11 and is guided via a supplementary guide 19 towards exit rollers 20, 21.

In prior art apparatus, the exit roller pairs are used to squeeze the photographic material after its liquid treatment in the processing liquid contained in the tray. With this arrangement, when the apparatus is only intermittently used, the processing liquid present on the exit rollers is so long exposed to ambient air that the solvent, which is normally water, has sufficient time to evaporate so that a solid residue accumulates on the peripheral surface of the exit rollers.

As a consequence thereof, the next coming sheet will be contaminated by this residue so that there is a real chance that part of the surfaces of said sheet will undergo an irreversible quality decrease that makes said material unsuited for further purposes. In order to avoid this unwanted effect, meams are provided in the apparatus according to the invention in order to continuously supply processing liquid to the peripheral surface of the exit rollers 20 and 21.

This is accomplished by providing a by-pass conduit 22 in the processing liquid supplying circuit 23 which deviates part of the flow of processing liquid 12 towards a dispensing element 24.

The dispensing element 24, as shown more in detail in FIG. 2, comprises a hollow chamber or manifold 27 formed by wall 28, bottom plates 29 and 30 and a closing element 31.

Between the bottom plates 29 and 30 a strip of leaf spring 32 is provided which extends tangentially to the periphery of roller 21 of the exit roller pair and over at least the axial length of this one roller.

Between the closing element 31 and the bottom plate 29 a small opening slot 33 is provided which also extends over the whole axial length of roller 21. Via this opening slot 33 of 1 mm or less, processing liquid is supplied from the chamber 27 to the leaf spring 32. The outflowing liquid is accumulated in the form of a bead of liquid 34 which continuously moistens the peripheral surface of roller 21 and, by transfer also that of roller 20. Processing liquid is supplied via channel 35 and through opening 36 into chamber 27 whereinafter it runs down to the leaf spring 32 and flows to the nip between the leaf spring 32 and roller 21.

As the amount of processing liquid necessary to wet the peripheral surface of the exit rollers is neglectable a small throttle valve 26, a diaphragm, or analogous device may be provided in the conduit 22 after T-branch pipe 25.

At the side edges of the dispensing element 24, small spindles 37 may be provided in order to bring said element somewhat out of balance so to create an upwardly directed force which urges leaf spring 32 against the roller 21. If desired, however, other means, such as springs (not shown) may be used to obtain the same effect.

Finally, in FIG. 3 it is shown that the opening slot 33 via which processing liquid is supplied to the leaf spring 32 may be divided into a plurality of channels in order to better meter the liquid flow.

We claim:

1. Processing apparatus for use in the controlled application of a processing liquid to sheet or web material, said apparatus comprising at least one container for holding a bath of processing liquid, means for feeding a said material along a path passing through the bath in said container, means comprising a pair of exit rollers located for receiving such material from an exit region of the container and for squeezing surplus liquid from such material emerging from the bath, and applicator means associated with one of said exit rollers for applying separate liquid to the roller periphery to wet the same, said applicator means comprising a supply manifold for said separate liquid extending generally parallel to the axis of the roller to be wetted over the length of the roller to be wetted, said manifold having an elongated narrow liquid metering slot along the side thereof toward said roller, an applicator blade of resilient flexible material affixed at one end to said manifold below said slot and bearing at its opposite free end against the surface of said roller to be wetted at a point on the periphery thereof proximate to its lowest region with a downward inclination from its affixed end to its free end, whereby said separate liquid cascades from said metering slot over the blade length and collects as a bead in the convergence of the blade end and said roller periphery.

2. Apparatus according to claim 1, wherein the applicator means includes means for automatically delivering said separate liquid to said supply manifold at least intermittently.

3. Apparatus according to claim 1, wherein said applicator blade is in the form of a leaf spring.

* * * * *